US007174676B1

(12) United States Patent
Armstrong

(10) Patent No.: US 7,174,676 B1
(45) Date of Patent: Feb. 13, 2007

(54) SELF-CLEANING GUTTER GUARD

(76) Inventor: Jonathan K. Armstrong, 6501 Commodore Sloat Dr., Los Angeles, CA (US) 90048

( * ) Notice: Subject to any disclaimer, the term of this patent is extended or adjusted under 35 U.S.C. 154(b) by 261 days.

(21) Appl. No.: 10/869,372

(22) Filed: Jun. 17, 2004

(51) Int. Cl.
*E04D 13/076* (2006.01)

(52) U.S. Cl. ..... 52/11; 52/12; 52/302.3

(58) Field of Classification Search ..... 52/11–16, 52/302.1, 302.3
See application file for complete search history.

(56) References Cited

U.S. PATENT DOCUMENTS 3,482,273 A * 12/1969 Price ..... 15/52.1
3,638,369 A * 2/1972 Albrecht ..... 52/16
4,241,547 A 12/1980 Bove
4,253,281 A * 3/1981 Ruttenberg ..... 52/12
4,602,460 A * 7/1986 Langenbach ..... 52/1
4,709,516 A * 12/1987 Gleaves ..... 52/11
5,357,719 A * 10/1994 Lewis ..... 52/11
D353,189 S 12/1994 Crowley
5,560,065 A * 10/1996 Young ..... 15/82
5,819,354 A * 10/1998 Alonso et al. ..... 15/104.05
5,867,945 A * 2/1999 Scafidi ..... 52/16
6,681,527 B2 * 1/2004 Baker ..... 52/12
6,964,135 B1 * 11/2005 Slodov ..... 52/11

* cited by examiner

*Primary Examiner*—Jeanette Chapman

(57) ABSTRACT

A device mountable to a gutter for removing debris therefrom includes an elongated shaft with proximal and distal end portions positionable within the gutter, a plurality of debris-removing members mounted about the shaft and between the proximal and distal end portions thereof, a plurality of brackets spaced along the gutter for receiving the shaft therethrough, and a mechanism for operating the device causing the debris-removing members to rotate in a select direction as desired by a user. The operating mechanism may rotate the debris-removing members in an oscillating path or unidirectional path and a sensor may also be included to selectively toggle the device between on and off modes, without direct user input.

17 Claims, 4 Drawing Sheets

SELF-CLEANING GUTTER GUARD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a gutter cleaning device and, more particularly, to a self-cleaning and rotatable gutter guard that is power-operable with or without direct user input.

2. Prior Art

Gutters are commonly used on buildings to collect rainwater flowing from a sloped roof and to direct the rainwater away from the building. Gutters not only prevent soil erosion adjacent to the building but also reduce damage to foundations and basements caused by water seepage into the soil adjacent to the building. A problem associated with gutters is the tendency to collect leaves and other debris within the gutter. Often the collected leaves and other debris clog the gutter rendering the gutter ineffective to collect rainwater. A gutter that becomes clogged with debris may overflow leading to landscaping erosion, damage to foundations and basements. Water seepage from a clogged gutter under the eaves of a roof can cause structural damage to the facia and soffits of a roof, and also to building walls and ceilings.

Water seepage and overflow from a blocked gutter can also enhance the potential for mold and fungal growth within the attic, adjacent walls and basements of a building. A clogged gutter can also cause structural damage at the gutter attachment points and damage to the gutter itself (bending and warping) due to the increased weight of water and debris within the gutter. Additionally, a clogged gutter can also provide a site for insect infestations e.g., mosquitoes.

Periodically cleaning out leaves, twigs and other debris that normally accumulate in gutters is typically a maintenance nuisance. For owners and occupiers of one, two and other multiple-family dwellings, this chore usually involves climbing up a ladder and manually removing such debris along the entire lengths of the gutters. Such an exercise involves risk and can even be dangerous. The accidents from falls off of ladders in attempts to complete this cleaning chore can result in sprains, broken limbs and other disabling injuries that are well documented in yearly statistics.

Gutter guards are devices that are placed over or in a gutter that act as filtration devices designed to prevent large debris (e.g., twigs and leaves) from entering a gutter while allowing rainwater to freely enter the gutter, with the aim to reduce or eliminate the need to manually clean a gutter. Commercially available gutter guards and gutter guards described in the literature are static devices comprised of a protective screen or louvered material that are placed over the open-topped gutter, or are static devices comprised of a porous sponge-like material placed within the gutter. While placing these protective static devices over or within open-topped gutters has reduced the frequency of such necessary maintenance, it has not eliminated it or the need to climb up a ladder and manually clean out the gutters.

These protective screens, louvered covers and porous sponge-like materials cannot completely eliminate all debris from entering a gutter, and eventually admit small or broken leaves, pine needles, small twigs and other debris. Cleaning gutters equipped with such screens and covers tends to increase the maintenance hazard as then, in addition to manually cleaning out the gutter, the protective screen or cover also has to be removed and replaced or cleaned. This has the potential to require several more trips up and down a ladder, thus enhancing the potential risk of falling from a ladder.

Due to the static nature of the commercially available gutter guards, all such devices rely on wind or rain to displace large debris from the top of the gutter guard. In the absence of heavy rainfall or strong wind, debris can accumulate on the static gutter guard and can cause the guard to become blocked over time. Additionally, the mere presence of a static material on the top of a gutter will act as an obstruction when compared to an open uncovered gutter that can potentially retard the flow of rainwater entering a gutter and allow rainwater to spill over the edge of a gutter and to the ground below, especially during heavy rainfall, or when a static gutter guard becomes partially blocked over time. During colder weather, rainwater that spills over the edge of a gutter and falls to the ground below can freeze forming sheets of ice leading to the potential for slip-fall accidents.

During winter the presence of a static cover over a gutter can enhance the potential for snow to settle on the gutter, making the gutter ineffective, raising the potential for ice accumulation on the ground below the gutter, and allowing for ice to build up under the shingles during thaw and refreeze. Additionally, accumulation of snow and ice on the gutter during winter due to the presence of a static gutter guard can lead to potential icicle formation from the edge of a gutter, posing a potential hazard due to icicles falling to the ground below.

Accordingly, a need remains for a dynamic self-cleaning gutter guard device that would maintain a debris-free gutter to overcome the above noted shortcomings.

BRIEF SUMMARY OF THE INVENTION

In view of the foregoing background, it is therefore an object of the present invention to provide a self-cleaning gutter guard. These and other objects, features, and advantages of the invention are provided by a device mountable to a gutter for removing debris therefrom.

The device includes an elongated shaft that has a centrally disposed longitudinal axis positionable within a gutter gulley and extending along a length thereof. The shaft has proximal and distal end portions oppositely disposed about the axis. The shaft preferably includes a plurality of removably engageable sections, for conveniently allowing a user to adjust a length thereof. Select ones of the plurality of sections have a notch formed therein and alternate ones of the plurality of sections have a flange portion extending outwardly therefrom. This allows the flange portions to be selectively insertable into corresponding ones of the notches so that the first and second sections can advantageously be maintained at a substantially stable position.

The present invention also includes a plurality of debris-removing members mounted about the shaft and between the proximal and distal end portions thereof. The plurality of debris-removing members are selectively rotatable about the axis of the shaft, preferably in a unidirectional radial path. In a preferred embodiment, the plurality of debris-removing members are in the form of a spiral about the axis of the shaft, such that a unidirectional rotation of the shaft and debris-removing members would move debris and water contained within the gutter toward the drain end of the gutter, akin to the principle of an Archimedes Screw. The unidirectional rotation of the spiral debris removing members would be in a direction such that the upper rotation of the debris removing members would be an outward movement from the building wall, such that large debris (e.g., leaves, twigs) would be prevented from entering the gutter and would be moved from the edge of the roof to the outer edge of the gutter where the debris would fall to the ground.

Alternately, the plurality of debris-removing members may be rotatable in a bi-directional radial path and oscillate between clockwise and counter clockwise directions. The plurality of debris-removing members preferably include a plurality of bristles radially extending outwardly from the shaft and have select lengths suitable for their application and for adequately contacting the inner surface of the gutter gulley during operating conditions.

The device further includes a plurality of brackets spaced along the gutter and are securable thereto. The plurality of brackets may be disposed substantially orthogonal to the shaft and extend between front and rear portions of the gutter. Each bracket receives the shaft therethrough so that the plurality of debris-removing members can advantageously be maintained at a substantially stable position during operating conditions.

The present invention also includes a mechanism for operating the plurality of debris-removing members and effectively causing same to rotate in a select direction, as desired by a user. The operating mechanism preferably includes a power source, a motor connected to power source and the proximal end portion of the shaft, and a control panel electrically coupled to the motor. The control panel generates an output signal based upon a corresponding user input. Such an output signal is transmitted to the motor so that the plurality of debris-removing members can be selectively rotated.

In a preferred embodiment, the operating mechanism may further include a sensor connected to the control panel for selectively toggling the device between operating and non-operating modes based upon a stimulus detected within an outer perimeter thereof. This sensor for controlling the operating and non-operating modes of the mechanism may include a rain sensor and/or a wind sensor, the rate of rotation or oscillation of the shaft may further be controlled by rainfall rate or wind speed. Alternately, the operating mechanism may be controlled by a non-electrically powered mechanical device, such as a wind- or water-operated mechanism, or mechanically rotated via a crank operated by the end user. The operating mechanism may further include a plurality of bearings disposed about the shaft and within the plurality of apertures for effectively assisting the plurality of debris-removing members to axially rotate within the gutter.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
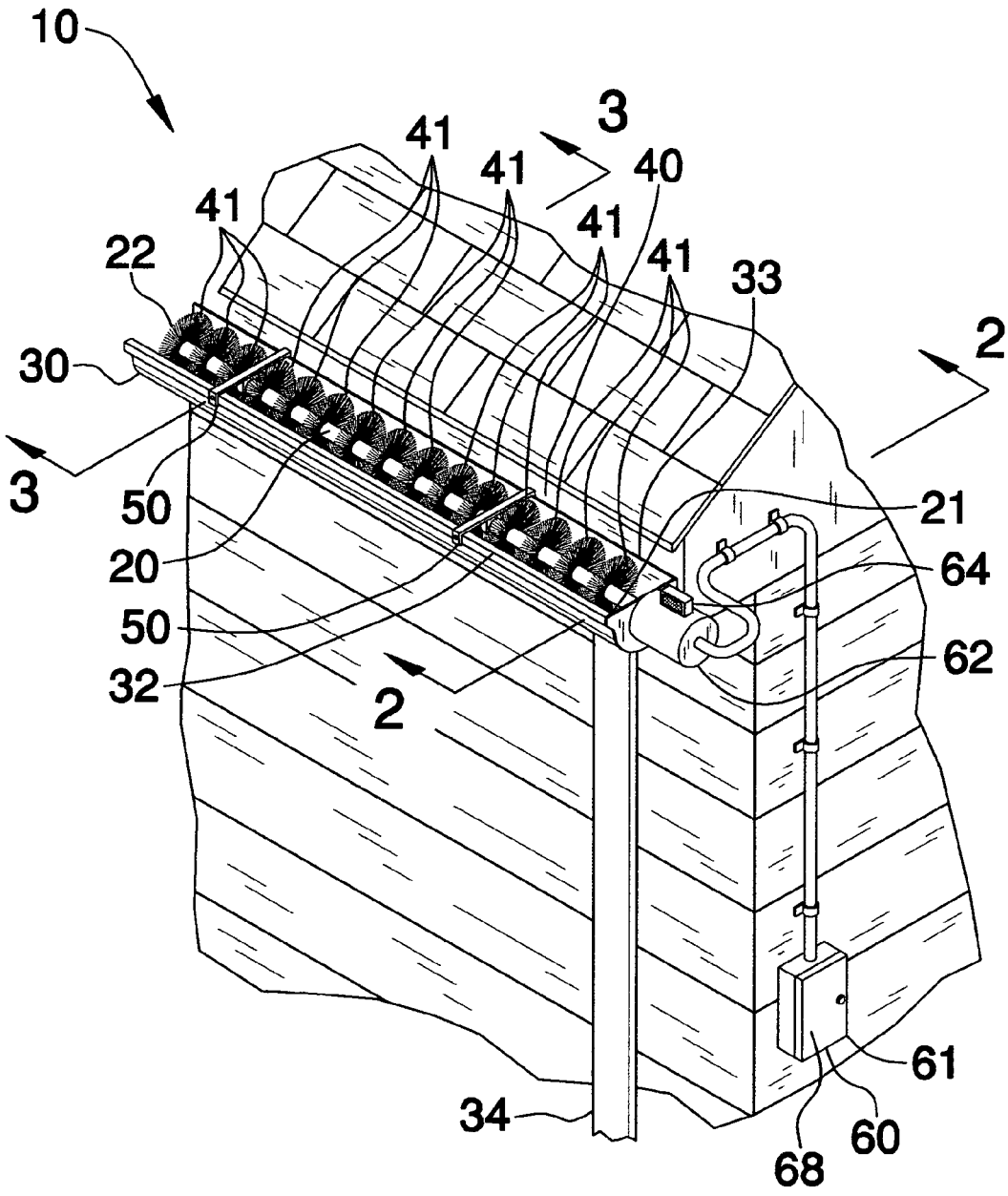
FIG. 1 is a perspective view showing a self-cleaning gutter guard, in accordance with the present invention.
Figure 2:
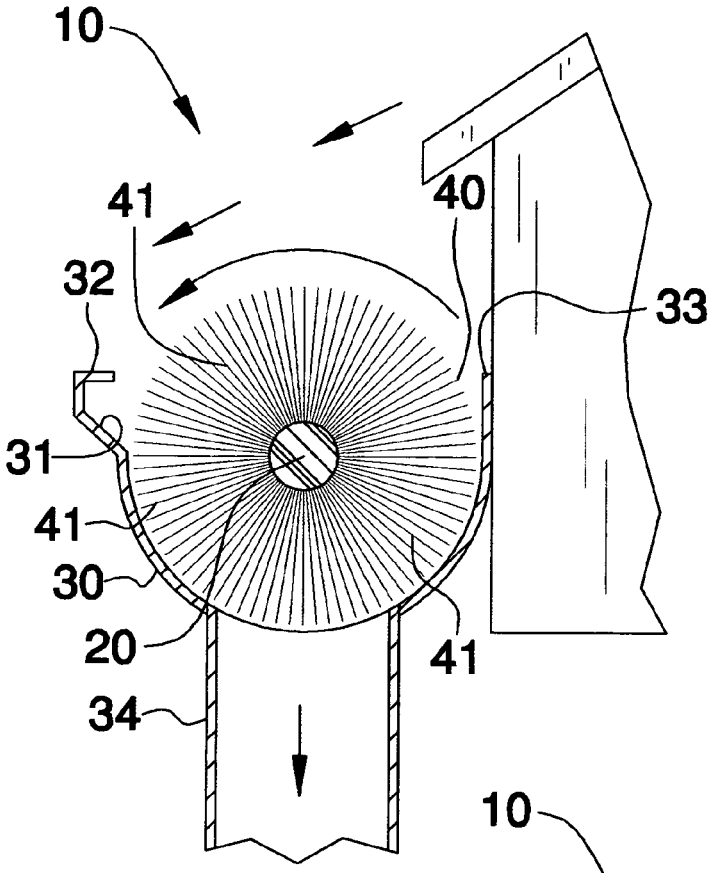
FIG. 2 is an enlarged cross-sectional view of the device shown in FIG. 1, taken along line 2—2, wherein debris is directed away from a roof soffit and over a gutter.
Figure 3:
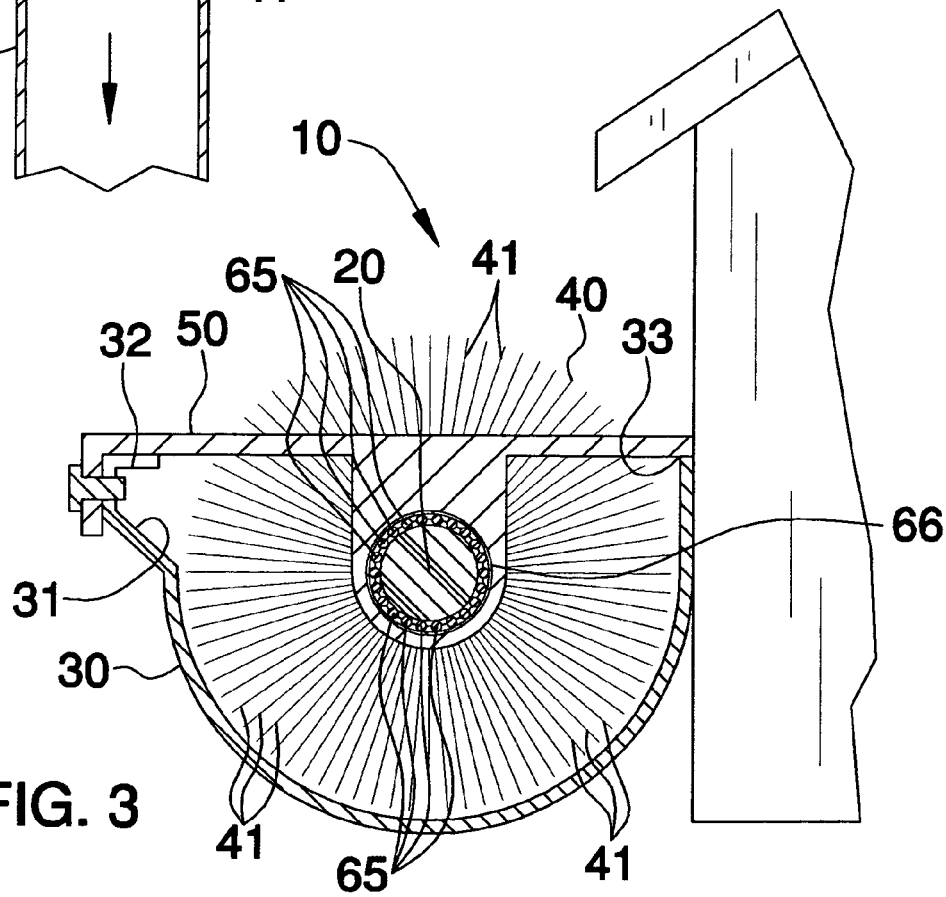
FIG. 3 is an enlarged cross-sectional view of the device shown in FIG. 1, taken along line 3—3, wherein a bracket is removably engaged with the gutter and maintains the shaft at an elevated position.
Figure 4:
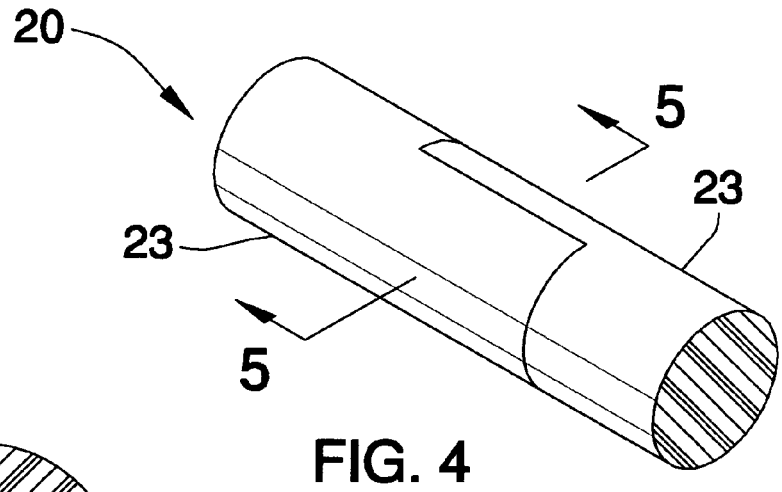
FIG. 4 is a partially enlarged perspective view of the shaft having adjoining sections.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–6 by the reference numeral 10 and is intended to provide a self-cleaning gutter guard. It should be understood that the device 10 may be employed to clean many different types of gutters and should not be limited to cleaning only horizontal disposed gutters.

Referring initially to FIG. 1, the device 10 includes an elongated shaft 20 that has a centrally disposed longitudinal axis positionable within a gutter gulley 30 and extending along a length thereof. The shaft 20 has proximal 21 and distal 22 end portions oppositely disposed about the axis. The shaft 20 includes a plurality of removably engageable sections 23 (FIG. 4 and FIG. 5), for conveniently allowing a user to adjust a length thereof. Advantageously, shaft 20 may be lengthened and shortened as desired by a user.

Figure 5:
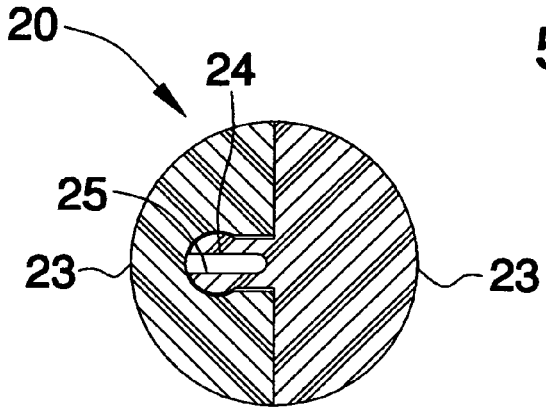
FIG. 5 is a cross-sectional view of the shaft shown in FIG. 4, taken along line 5—5, wherein a notch and a flange portion are engaged together.
Figure 6:
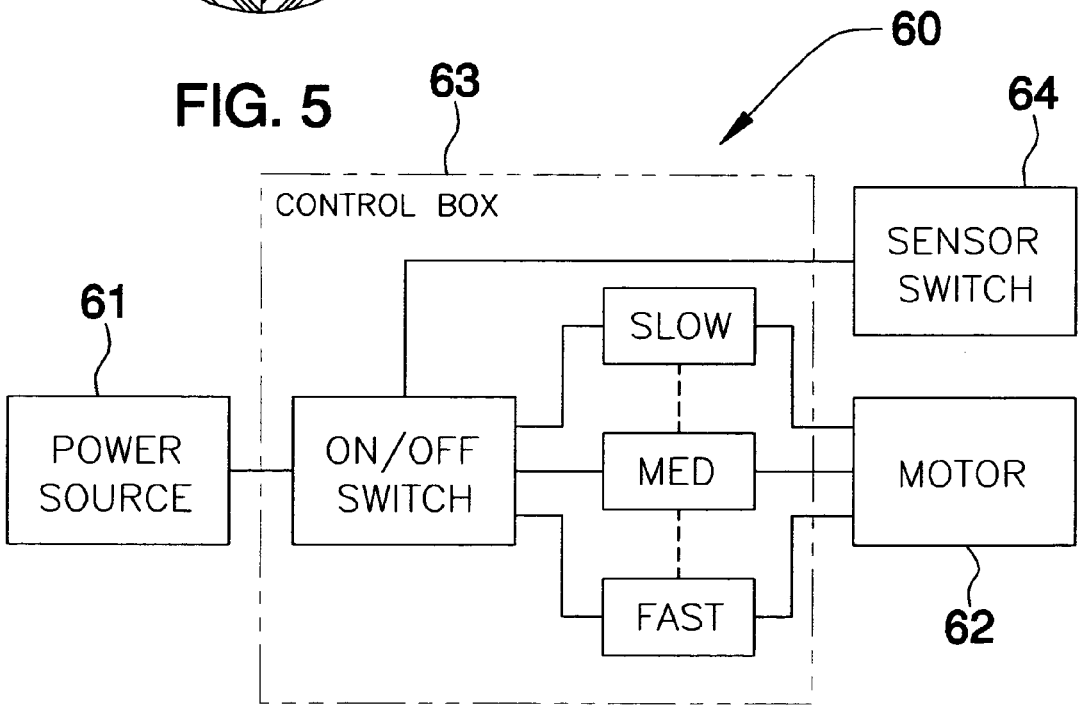
FIG. 6 is a schematic block diagram of the operating mechanism shown in FIG. 1.
Figure 7A:
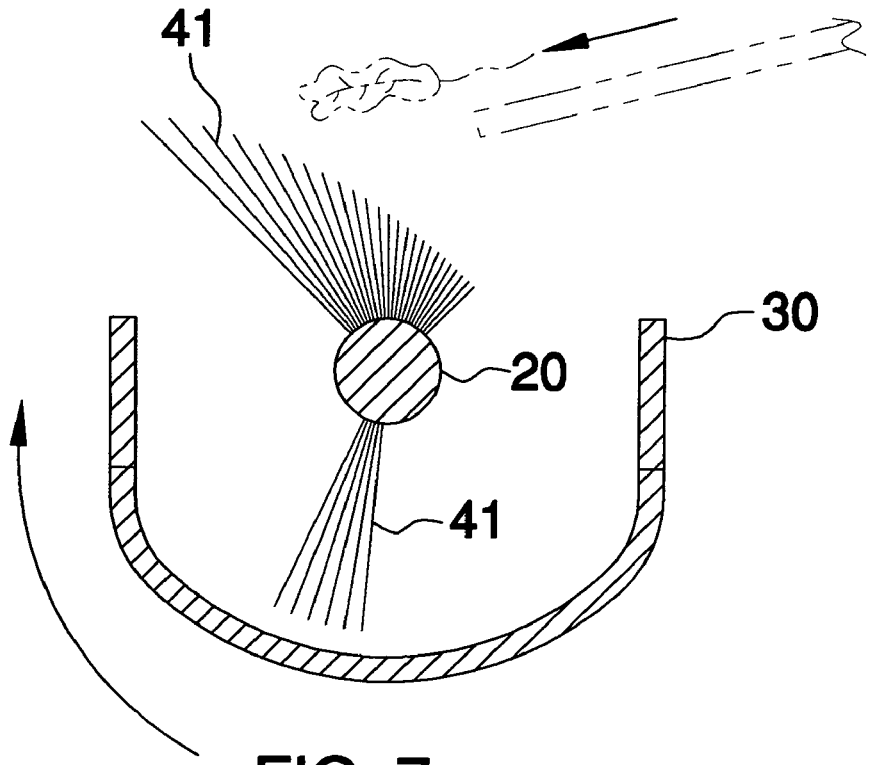
FIGS. 7*a* and 7*b* are cross-sectional view of the shaft showing movement along an oscillating path between clockwise and counterclockwise paths.
Figure 7B:
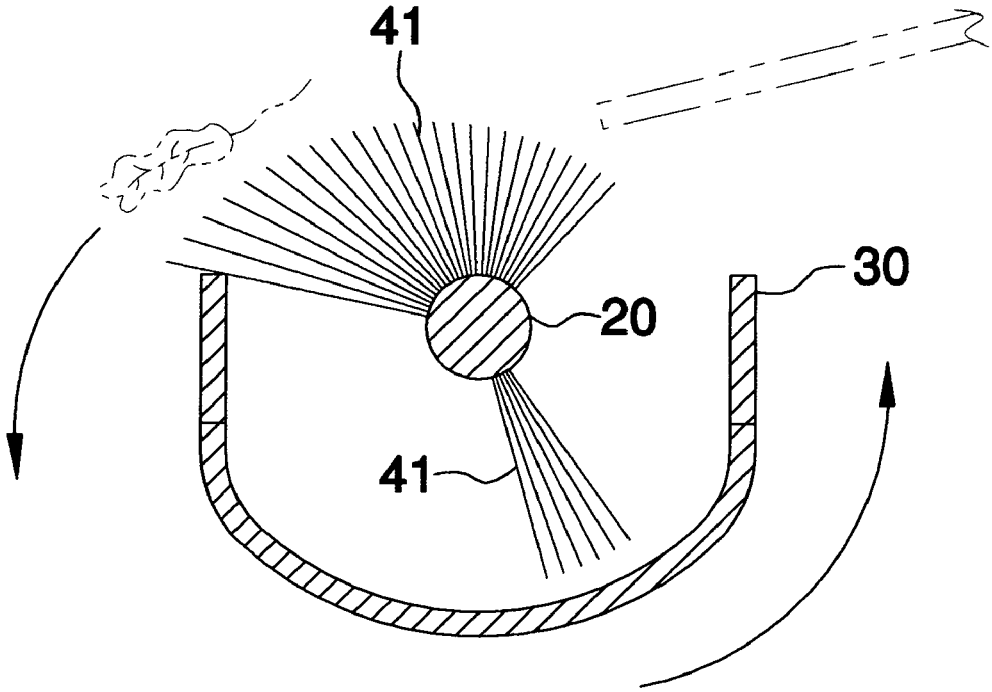

Referring to FIG. 5, select ones of the plurality of sections 23 have a notch 24 formed therein and alternate ones of the plurality of sections 23 have a flange portion 25 extending outwardly therefrom. This allows the flange portions 25 to be selectively insertable into corresponding ones of the notches 24 so that the first and second sections 23 can be maintained at a substantially stable position.

The present invention also includes a plurality of debris-removing members 40 mounted about the shaft 20 and between the proximal 21 and distal 22 end portions thereof.

The plurality of debris-removing members 40 are selectively rotatable about the axis of the shaft 20, in a unidirectional radial path. Alternately, the plurality of debris-removing members 40 may be rotated in a bi-directional radial path wherein members 40 oscillate between clockwise and counterclockwise directions. Rotation of the debris-removing members 40 advantageously directs debris lodged in the gutter gulley 30 outwardly from the gutter and away from the down-pipe 34, so that the debris does not become lodged adjacent the down-pipe 34 entrance.

The plurality of debris-removing members 40 include a plurality of bristles 41 radially extending outwardly from the shaft 20 and have select lengths suitable for their application and for adequately contacting the inner surface 31 of the gutter gulley 30 during operating conditions. Adequate contact of the bristles 41 with the gutter gulley 30 ensures complete cleaning thereof, which helps reduce the possibility of fine particulates remaining in the gutter gulley 30.

The plurality of debris-removing members 40 include a plurality of bristles 41 radially extending outwardly and spiraled about the shaft 20 and have select lengths suitable for their application and for adequately contacting the inner surface 31 of the gutter gulley 30 during operating conditions. Referring to FIG. 1, an anticlockwise rotating motion of the shaft 20 of the spiral design of the plurality of debris removing members 40 would facilitate enhanced movement of water and debris toward the down-pipe of the gutter 34. Adequate contact of the bristles 41 with the gutter gulley 30 ensures complete cleaning thereof, which helps reduce the possibility of fine particulates remaining in the gutter gulley 30. Additionally, an anticlockwise rotating motion of the shaft 20 of the spiral design of the plurality of debris removing members 40 would inhibit large debris from entering the gutter by facilitating movement of large debris (e.g., leaves, twigs) from the edge of a roof to the outer edge of the gutter where the debris would fall to the ground.

The device 10 further includes a plurality of brackets 50 spaced along the gutter 30 and are securable thereto. The plurality of brackets 50 are disposed substantially orthogonal to the shaft 20 and extend between front 32 and rear 33 portions of the gutter 30. Each bracket 50 receives the shaft 20 therethrough so that the plurality of debris-removing members 40 can advantageously be maintained at a substantially stable position during operating conditions.

The present invention also includes a mechanism 60 for operating the plurality of debris-removing members 40 and effectively causing same to rotate in a select direction, as desired by a user. The operating mechanism 60 conveniently allows for hands-free cleaning of gutters 30, reducing the chance of individuals falling off of a ladder and sustaining injuries while manually trying to clean their gutters 30. The operating mechanism 60 includes a power source 61, a motor 62 connected to the power source 61 and the proximal end portion 21 of the shaft 20, and a control panel 63 electrically coupled to the motor 62. The control panel 63 generates an output signal based upon a corresponding user input. Such an output signal is transmitted to the motor 62 so that the plurality of debris-removing members 40 can be selectively rotated.

The operating mechanism 60 further includes a sensor 64 connected to the control panel 63 for selectively toggling the device 10 between operating and non-operating modes based upon a stimulus detected within an outer perimeter thereof. The sensor 64 may include a rain and/or wind sensor connected to the control panel 63, further, the rate of rotation or oscillation of the device 10 may be controlled by the rate of rainfall or wind speed. Accordingly, a user will not need to manually activate the present invention. Rather, the mechanism 60 is conveniently activated when cleaning is needed without unnecessary requisite labor, eliminating the chance of individuals falling off of a ladder and sustaining injuries while manually trying to clean their gutters 30.

The operating mechanism 60 further includes a plurality of bearings 65 disposed about the shaft 20 and within the plurality of apertures 66 for effectively assisting the plurality of debris-removing members 40 to axially rotate within the gutter 30. The presence of the bearings 65 not only assist the rotating movement of the shaft, but also decrease the friction between the shaft 20 and the rotating debris-removing members 40. Advantageously, the wear-and-tear on the device 10 is reduced while effectively increasing the durability of the present invention.

The appealing features of the device 10 are its convenience, ease of use/installation, compactness and the ability to eliminate the need for a homeowner to clean their gutter system while standing on a ladder. Homeowners will find the device 10 easy to install since the sections simply snap together, and then only need to be secured to the opposite ends of the gutter. This task can easily be performed by the homeowner or a professional skilled in gutter installations and will especially be appreciated by owners of apartment complexes and the elderly.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A device mountable to a gutter and for removing debris therefrom, said device comprising:

an elongated shaft having a centrally disposed longitudinal axis positionable within a gutter gulley and extending along a length thereof, said shaft having proximal and distal end portions oppositely disposed about the axis;

a plurality of debris-removing members mounted about said shaft and between said proximal and distal end portions, said plurality of debris-removing members being selectively rotatable about the axis of said shaft;

a plurality of brackets spaced along the gutter and being securable thereto, said plurality of brackets for receiving said shaft therethrough so that said plurality of debris-removing members can be maintained at a substantially stable position during operating conditions; and means for operating said device and thereby causing said plurality of debris-removing members to rotate in a select direction as desired by a user;

wherein said shaft comprises a plurality of removably engageable sections for allowing a user to adjust a length of said shaft, select ones of said plurality of sections having a notch formed therein and alternate ones of said plurality of sections having a flange portion extending outwardly therefrom, said flange portions being selectively insertable into corresponding ones of said notches so that said first and second sections can be maintained at a substantially stable position.

2. The device of claim 1, wherein said plurality of debris-removing members comprise: a plurality of bristles radially extending outwardly from said shaft, said plurality of bristles having a select length for contacting the gutter gulley during operating conditions.

3. The device of claim 1, wherein said plurality of brackets are disposed substantially orthogonal to said shaft and extend between front and rear portions of the gutter.

4. The device of claim 1, wherein said operating means comprises:

a power source;

a motor connected to power source and said proximal end portion of said shaft; and a control panel electrically coupled to said motor, said control panel for generating an output signal based upon a corresponding user input, said output signal being transmitted to said motor so that said plurality of debris-removing members can be selectively rotated.

5. The device of claim 1, wherein operating means further comprises: a sensor connected to said control panel and for selectively toggling said device between operating and non-operating modes based upon a stimulus detected within an outer perimeter thereof.

6. The device of claim 1, wherein said operating means further comprises: a plurality of bearings disposed about said shaft for assisting said plurality of debris-removing members to axially rotate within the gutter.

7. The device of claim 1, wherein said plurality of debris-removing members are rotatable about a unidirectional radial path.

8. The device of claim 1, wherein said plurality of debris-removing members are rotatable about a bi-directional radial path and oscillate between clockwise and counter clockwise directions.

9. A device mountable to a gutter and for removing debris therefrom, said device comprising:

an elongated shaft having a centrally disposed longitudinal axis positionable within a gutter gulley and extending along a length thereof, said shaft having proximal and distal end portions oppositely disposed about the axis;

a plurality of debris-removing members mounted about said shaft and between said proximal and distal end portions, said plurality of debris-removing members being selectively rotatable about the axis of said shaft;

a plurality of brackets spaced along the gutter and being securable thereto, said plurality of brackets for receiving said shaft therethrough so that said plurality of debris-removing members can be maintained at a substantially stable position during operating conditions; and means for operating said device and thereby causing said plurality of debris-removing members to rotate in a select direction as desired by a user;

wherein said plurality of debris-removing members comprise a plurality of bristles radially extending outwardly from said shaft, said plurality of bristles having a select length for contacting the gutter gulley during operating conditions;

wherein said shaft comprises a plurality of removably engageable sections for allowing a user to adjust a length of said shaft, select ones of said plurality of sections having a notch formed therein and alternate ones of said plurality of sections having a flange portion extending outwardly therefrom, said flange portions being selectively insertable into corresponding ones of said notches so that said first and second sections can be maintained at a substantially stable position.

10. The device of claim 9, wherein said plurality of brackets are disposed substantially orthogonal to said shaft and extend between front and rear portions of the gutter.

11. The device of claim 9, wherein said operating means comprises:

a power source;

a motor connected to power source and said proximal end portion of said shaft; and a control panel electrically coupled to said motor, said control panel for generating an output signal based upon a corresponding user input, said output signal being transmitted to said motor so that said plurality of debris-removing members can be selectively rotated.

12. The device of claim 9, wherein operating means further comprises: a sensor connected to said control panel and for selectively toggling said device between operating and non-operating modes based upon a stimulus detected within a outer perimeter thereof.

13. The device of claim 9, wherein said operating means further comprises: a plurality of bearings disposed about said shaft for assisting said plurality of debris-removing members to axially rotate within the gutter.

14. The device of claim 9, wherein said plurality of debris-removing members are rotatable about a unidirectional radial path.

15. The device of claim 9, wherein said plurality of debris-removing members are rotatable about a bi-directional radial path and oscillate between clockwise and counter clockwise directions.

16. A device mountable to a gutter and for removing debris therefrom, said device comprising:

an elongated shaft having a centrally disposed longitudinal axis positionable within a gutter gulley and extending along a length thereof, said shaft having proximal and distal end portions oppositely disposed about the axis;

a plurality of debris-removing members mounted about said shaft and between said proximal and distal end portions, said plurality of debris-removing members being selectively rotatable about the axis of said shaft;

a plurality of brackets spaced along the gutter and being securable thereto, said plurality of brackets for receiving said shaft therethrough so that said plurality of debris-removing members can be maintained at a substantially stable position during operating conditions, said plurality of brackets being disposed substantially orthogonal to said shaft and extending between front and rear portions of the gutter; and means for operating said device and thereby causing said plurality of debris-removing members to rotate in a select direction as desired by a user, said operating means comprising a power source, a motor connected to power source and said proximal end portion of said shaft, a control panel electrically coupled to said motor, said control panel for generating an output signal based upon a corresponding user input, said output signal being transmitted to said motor so that said plurality of debris-removing members can be selectively rotated, and a sensor connected to said control panel and for selectively toggling said device between operating and non-operating modes based upon a stimulus detected within a outer perimeter thereof;

wherein said plurality of debris-removing members comprise a plurality of bristles radially extending outwardly from said shaft, said plurality of bristles having a select length for contacting the gutter gulley during operating conditions;

wherein said shaft comprises a plurality of removably engageable sections for allowing a user to adjust a length of said shaft, select ones of said plurality of sections having a notch formed therein and alternate ones of said plurality of sections having a flange portion extending outwardly therefrom, said flange portions being selectively insertable into corresponding ones of said notches so that said first and second sections can be maintained at a substantially stable position.

17. The device of claim 16, wherein said operating means further comprises: a plurality of bearings disposed about said shaft for assisting said plurality of debris-removing members to axially rotate within the gutter.

* * * * *